US005894958A

United States Patent [19]

De Laforcade

[11] Patent Number: 5,894,958

[45] Date of Patent: Apr. 20, 1999

[54] PRESSURIZED DEVICE WITH TWO VALVES

[75] Inventor: Vincent De Laforcade, Rambouillet, France

[73] Assignee: L'Oreal, Paris, France

[21] Appl. No.: 09/012,178

[22] Filed: Jan. 22, 1998

[30] Foreign Application Priority Data

Jan. 22, 1997 [FR] France ..... 97 00635

[51] Int. Cl.[6] ..... B65D 83/14

[52] U.S. Cl. ..... 222/136; 222/1; 222/402.1

[58] Field of Search ..... 222/1, 135, 136, 222/129, 402.1, 402.2, 394

[56] References Cited

U.S. PATENT DOCUMENTS

| | | | |
|---|---|---|---|
| 3,180,535 | 4/1965 | Ward | 222/402.2 X |
| 3,181,737 | 5/1965 | Chaucer | 222/136 |
| 3,211,346 | 10/1965 | Meshberg | 222/402.1 X |
| 3,434,718 | 3/1969 | Siegel et al. | 222/136 X |
| 3,447,722 | 6/1969 | Mason | 222/136 |
| 3,637,114 | 1/1972 | Meshberg | 222/135 |

FOREIGN PATENT DOCUMENTS

| | | |
|---|---|---|
| 0 063 759 | 11/1982 | European Pat. Off. . |
| 0 217 582 | 4/1987 | European Pat. Off. . |
| 1 228 733 | 9/1960 | France . |
| 1 431 181 | 5/1966 | France . |
| 2 378 572 | 8/1978 | France . |
| 11 66 225 | 3/1964 | Germany . |

*Primary Examiner*—Kevin P. Shaver
*Attorney, Agent, or Firm*—Oblon, Spivak, McClelland, Maier & Neustadt, P.C.

[57] ABSTRACT

The present application concerns a device including a reservoir for a pressurized product, whereon there are mounted a first valve and a second valve, the second valve being orientated in the opposite direction to the first valve and substantially in alignment with the first valve. Actuating and dispensing elements are associated with at least one of the first and second valves. Each one of the valves include apparatus for selectively producing the opening/closing of the valves in response to a command, and an elastic restoring element for urging the opening/closing apparatus into the closed position in the absence of a command. In accordance with the invention, the first and second valves are mounted inside one and the same valve body communicating with the reservoir and are urged into the closed position by the same elastic restoring element.

30 Claims, 4 Drawing Sheets

PRESSURIZED DEVICE WITH TWO VALVES

BACKGROUND OF THE INVENTION

1. Field of the Invention

The object of the invention is a new pressurized container having a small number of parts: two valves, namely a first valve for the dispensing of the product, and a second valve for the fling of the container, either for refilling the container when its contents have been used up, or for adding an additional active ingredient to the product initially contained in the container. The invention is particularly suitable for the dispensing of cosmetic or dermo-cosmetic products in the form of a liquid, a foam, a gel or a cream.

2. Discussion of the Background

Since the time that pressurized devices, for example of the aerosol type, have been in existence, the need for using a refillable system has made itself felt. The advantages of this type of packaging are manifold. One can in fact envisage having available a container with a relatively large volume containing the product, and a small container that can be easily carried and filled at will and can be taken along for a weekend, for a walk, to the office, to the beach, etc.

Moreover, such a small-sized device can be advantageously used for a precise dosing of the product during each use, and this above all in the pharmacological and dermo-cosmetic fields. However, in spite of this need, such a concept has not seen the light of day, mainly for reasons of cost.

One of the problems relates to the difficulty of making such a small-sized device at a competitive price. Indeed, in the case of products supplied in pressurized containers, while it is easy to prepare packages of small size which allow for the original formula, the economic criterion which the device has to meet is at present not complied with. In fact, a pressurized container, even of a small size, requires a certain number of indispensable elements for its operation, that is to say, a can made of tin or aluminium on whose walls there is deposited a varnish and on whose neck a valve is crimped by means of a valve-carrier cup, as well as a dispensing means connected to the valve.

Now the technology of manufacturing pressurized cans does not make it possible to manufacture cans that are sufficiently small to correspond to the volume of a trial dose, that is to say approximately 3.5 ml to 8 ml. Indeed, the task of metal crimping (crimping the valve-carrier cup onto the container body on the one hand, and around the valve on the other hand) which lies in forcing the metal to take on the desired configuration, in particular to come to grip the valve tightly, is an operation that can only be performed on components of a sufficiently large size. This manufacturing constraint hence governs the size of the valve-carrier cup, and consequently the volume of the can which is necessarily greater than a unit dose.

Moreover, these operations of manufacturing the can are expensive, just as is the incorporation of a valve into the can, which, nevertheless forms one of the indispensable elements for the functioning of the pressurized container.

This problem of cost is even more critical when one is concerned with making such a small-sized device with two valves, namely (i) a first for dispensing the product, and (ii) a second for filling the reservoir, either after its contents have been completely emptied, or with a view to mixing a first product contained in the reservoir with a second product contained in an auxiliary container.

There do certainly exist refillable devices of the aerosol type, formed by a "small" can which is surmounted by a first valve, and at whose bottom a second valve has been added for refilling the can. The aerosol is refillable by means of another aerosol device with a greater volume. The cost of this refillable aerosol is thus simply that of a conventional aerosol, to which there is added the cost of supplying and mounting the second valve, that is to say, a very high cost having regard to the small volume of the can.

In fields other than those of cosmetics there exist examples of this type of association between a small volume refillable device, and an aerosol of a greater volume, intended for the refilling of the small device. This is, in particular, the case with refillable lighters for smoking articles (such as cigarettes).

Nevertheless, such refillable devices are always constituted by a container with a first valve for the dispensing of the product, and by a filling system which is in fact neither more nor less than a second valve.

By way of example, there may be cited DE-B-1 166 225 which describes such a can fitted with two valves, each of the valves comprising a valve body and a separate spring for keeping the valves in the closed position in the absence of an actuation command.

FR-A-1 228 733 describes a refillable aerosol can, wherein the filling or refilling is effected by means of an auxiliary can through the same valve as that used for the dispensing of the product. However, this device requires the push button to be raised before operating the refilling, which can sometimes be difficult and after multiple refilling operations it can make the mounting of the push button on the refillable container fragile.

Similarly, FR-A-2 378 572 describes a method making it possible to draw up and store a predetermined dose of a product inside a detachable head. The two operations are effected simultaneously by (i) the compression of a spring while the head is screwed down onto a reservoir, and (ii) the compression of the dose stored at a sufficient pressure by slackening the head and releasing the same spring, so that after the separation of the head and of the reservoir the head has been made independent and can be used as an aerosol can.

Another problem lies in offering the user of cosmetic products, products blending two active ingredients in a single formula. By way of example, one may cite the whole range of "two in one" products that are available on the market, such as medicated shampoos, nourishing hair products, moisturising cleansing creams, etc. Such a packaging is only possible to the extent that the two active ingredients are compatible with each other and with the carrier. Now, in the present state of the art, it is impossible to formulate certain formulas since the two active ingredients are incompatible with each other. Hence "all in one" systems have been proposed which are most frequently complex and lie in packaging the two active ingredients separately until the time of use, when they will be mixed by the consumer in a more, or less, fast and easy way. This type of packaging is frequently found in the field of colouring oxidizing agents and perms.

The difficulty with such products relates to the fact that, since the active ingredients are not stable when they are mixed, they must be used quickly after mixing, and hence must be either single-dose products, or of a sufficiently small volume to be used in a space of time shorter than the time over which the mixture remains sufficiently active, so as to be used with good efficiency.

EP-A-063 759 and EP-A-217 582 describe systems for mixing two products extemporaneously by means of pressurized devices, the mixing being carried out in a device with two valves: namely one valve for the intake and one valve for the dispensing. Each one of the valves has a cup, a valve body, a valve stem, a joint and a spring. Such a design has the drawback of being expensive because of the number of components used. Moreover, it does not permit the manufacture of single-dose devices or multidose devices of a small volume. A similar system is described in FR-A-1 431 181.

SUMMARY OF THE INVENTION

Thus, one of the objects of the present invention is to provide a refillable pressurized device without the drawbacks, in particular those relating to cost, of the existing devices referred to above.

It is, in particular, one object of the invention to provide a refillable system with a limited number of parts as compared with existing devices.

Yet another object of the invention is to provide a single-dose or multidose packaging (preferably of small volume), which makes it possible to package two active ingredients in a totally separate way, which can be mixed in a simple and extemporaneous manner just as well for formulas amenable to an aerosol action, (foams and sprays for example) as for formulas not amenable to an aerosol action (liquid to pasty and self-foaming formulas, for example), whose cost of filling does not substantially exceed that of single component packages, and which, moreover, permits the creation of active combinations that are completely new to date.

Other objects of the invention will emerge in detail manner in the description that follows.

In accordance with a first aspect of the invention, these objects are achieved by means of a device comprising a reservoir for a pressurized product whereon there are mounted a first valve and a second valve, the second valve being orientated in the opposite direction to the first valve and substantially in alignment with the first valve; dispensing means associated with at least one of the first and second valves, each of the valves comprising means for selectively permitting the opening/closing of the valves in response to a command; and elastic restoring means for urging the opening/closing means into the closed position in the absence of a command; characterized in that the first and second valves are mounted inside one and the same valve body communicating with the reservoir and are urged into the closed position by the same elastic restoring means. There is obtained a device with two valves with their independent operation, and this with a limited number of parts.

The opening/closing means of the first and/or second valve may be formed by an emergent valve stem, of a lateral pivoting, or push down-type. A lateral pivoting stem is a stem mounted so as to be capable of pivoting outside its axis, so as to cause a passage or opening arranged in the vicinity of its lower end to communicate with the valve body on which it is mounted, thus allowing the pressurized product contained in the valve body to rise up inside the valve stem with a view to its dispensing. In the case of a push-down-type valve stem, the communication of the passage or opening is ensured by pushing down the stem in the valve body, along the axis of the stem.

Alternatively, the opening/closing means of the first and/or of the second valve are formed by a female element capable of receiving an actuating stem in a detachable manner. This actuating stem may form an integral part of an actuating and dispensing device of the push button type, or be formed by the emergent valve stem of an auxiliary container used to refill the device. This characteristic, in particular in the case of the valve intended for the refilling of the container, constitutes a possible solution to the problem of the accidental actuation of the filer valve.

The device may comprise a push button mounted on the first valve with a view to the actuation of the valve and the dispensing of the product, the second valve being intended for the refilling or further filling of the reservoir. Advantageously, the push button has a diffusion means such as a grille, a porous dome or a nozzle.

According to an advantageous embodiment, the device has a reservoir body and a reservoir bottom element, the reservoir body forming a valve-carrier cup for the first valve, the reservoir bottom element forming a valve-carrier cup for the second valve, and the reservoir body of the device cooperates with the reservoir bottom element to form, on the one hand, the reservoir for the pressurized product and, on the other hand, the valve body for the first and second valves. This configuration is particularly advantageous in that it contributes still more significantly to limiting the size of the device and the number of parts used in such a device, thus also reducing its cost of manufacture. Moreover, the assembly of such a device is very simple.

The first valve may have a first valve stem, of which a first end opens inside the valve body and the second end opens outside the valve body, the second valve having a second valve stem of which a first end opens inside the valve body, substantially opposite the first end of the first valve stem, and the second end opens outside the valve body, the elastic restoring means being formed by a spring bearing between the first ends of the first and second valve stems.

The first end of the second valve stem advantageously has a substantially flat portion, one side of which is situated opposite the bottom of the valve body, the second valve being held in the closed position by an elastic bearing contact between a sealing ring formed on said side and a gasket traversed by the second valve stem and disposed in the bottom of the valve body, said gasket being in tight contact, on the one hand with the internal sides of the second central duct, and on the other hand with the second valve stem. The body of the device may be mounted in a leakproof manner on the bottom by welding, catch engagement, screwing or bonding.

The body may be formed by a transverse side, or transverse wall, forming a valve-carrier cup for the first valve, by a first lateral skirt delimiting an outer contour for the reservoir, and by a first central duct with a given internal diameter and delimiting an internal contour for the reservoir, the bottom having a transverse side forming a valve-carrier cup for the second valve, a second lateral skirt cooperating with the first for fastening the bottom onto the body, and a second central duct forming a valve body, the second central duct having an external diameter slightly smaller than the internal diameter of the first central duct, and means being provided to permit communication between the reservoir and the valve body.

According to a preferred embodiment, the transverse side of the reservoir body has outside the device an annular groove between the first lateral skirt and the first central duct so as to receive a free edge of the dispensing means.

The first and second central ducts are preferably of substantially the same height, the first central duct having a free edge welded to the transverse side of the reservoir bottom element.

The means permitting communication between the reservoir and the valve body are arranged so as to allow the device to function either upside down or the right way up, or in any other position of the device. The choice of a given configuration depends on the application of the device and of its conditions of use.

According to one embodiment, the reservoir bottom element has a setback in which there emerges the second valve stem, the setback having a height along the axis of the device greater than the height of the emergent portion of the second valve stem. According to one alternative, such a setback is advantageously used in the case of an opening/closing element of the female type for the stacking of several such devices. Such a setback can have on its side walls outside the device a profile forming a key, said key profile being complementary to that of an adapter intended to be mounted on an auxiliary container with a view to the refilling of the device. This characteristic makes it possible to prevent, or at any rate to limit substantially, the risks of filling the container with a product other than that prescribed by the manufacturer of the device, which could constitute a danger for the person undertaking such a filling operation. This arrangement makes it also possible to limit the risk of having a container initially sold as a given commercial brand, subsequently refilled with a competitor's product.

The reservoir bottom element may have, between the second lateral skirt and the second central duct, a rounded annular profile whose concavity faces inwardly of the reservoir. This characteristic contributes substantially to improving the extent to which the reservoir is emptied.

Again advantageously, the first end of the first valve stem forms an axial stop so as to limit the movement of the second valve stem during the opening of the second valve with a view to the filling or refilling of the reservoir.

The end of the second valve stem opening outside the device preferably has a shape adapted to cooperate with a free end of a valve stem of an auxiliary pressurized container with a view to the refilling of the device. By way of example, said end of the second valve stem has a frustoconical profile.

The product may be pressurized by means of a liquefiable gas admixed to the product for the formulas amenable to an aerosol action. For other formulas, the pressurization is obtained by an element made of a cellular material with closed cells, by means of a non-liquefiable gas above the free surface of the product, or by means of a pressurized gas separated from the product by means of a flexible or rigid piston, a diaphragm or a pouch-type element, etc.

According to a second aspect of the invention there is provided a unit for the preparation of an extemporaneous mixture of at least two products A and B, intended to be dispensed under pressure, comprising:

a) at least one first device formed by a reservoir partially filled with the product A at a given pressure, and comprising dispensing means and intake means;

b) a second device formed by a reservoir containing the product B at a pressure higher than the pressure in the first device, the second device having means for dispensing the pressurized product B, said dispensing means being capable of cooperating with the means for the intake of the first device, with a view to transferring the product B into the first device; and c) means for pressurizing the mixture A+B in the first device with a view to dispensing it via the dispensing means of the first device;

wherein the first device is in accordance with the first aspect of the invention.

Advantageously, the unit comprises, moreover, an adapter for the mounting of the dispensing means of the second device on the intake means of the first device, with a view to transferring the product B into the first device.

The means for pressurizing the mixture A+B may comprise a liquefiable propellant gas or a non-liquefiable propellant gas, optionally separated from the mixture by a flexible pouch or a piston. Alternatively, the means for pressurizing the mixture A+B comprise a block of closed cellular foam.

The product B may be kept under pressure in the reservoir of the second device by a liquefiable propellant gas, by a cellular foam block with closed cells or by a non-liquefiable propellant gas optionally separated from the mixture by a piston or a flexible pouch.

According to a third aspect of the invention, a method is also created for preparing an extemporaneous mixture of at least two products A and B intended to be dispensed under pressure, characterized in that it is operated by means of a unit in accordance with the second aspect of the invention.

The product A may be placed into position in the first device during the assembly of the first device; or after assembly of the first device by transfer from another pressurized device.

The product A may take the form of a powder (a vitamin, enzymes, etc.), a liquid or a cream (silicone for hair styling and fixing sprays, etc.).

The mixture A+B is chosen, for example, from the following mixtures: keratolytic enzymes/a moisturising lotion, vitamins/a nourishing cream, fixing sprays/gloss sprays, a hair styling foam/combing-out foam, etc.

BRIEF DESCRIPTION OF THE DRAWINGS

Apart from the arrangements set out above, the invention consists of a certain number of other arrangements which will be explained below with regard to non-restrictive examples of embodiments, described with reference to the attached drawings, wherein:

FIG. 3*a* and 3*b* illustrate another embodiment of the refillable device in accordance with the present invention.

DESCRIPTION OF THE PREFERRED EMBODIMENTS

Figure 1:
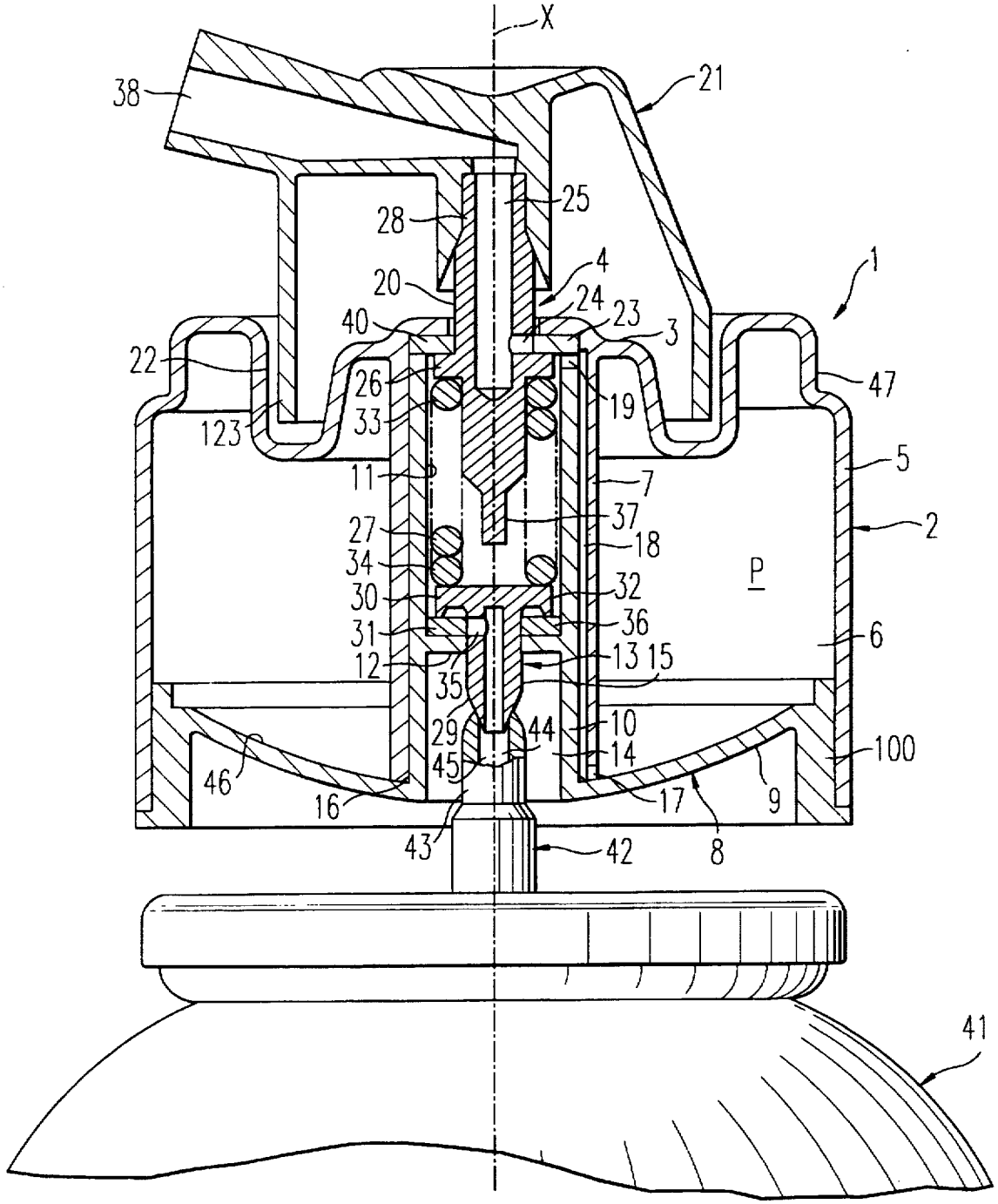
FIG. 1 shows a first embodiment of the device in accordance with the invention.

The pressurized container of FIG. 1, of a general cylindrical shape with axis X consists of a reservoir body 2 having a transverse panel 3 forming a valve-carrier cup for a dispensing valve 4. The reservoir body has a lateral skirt 5, delimiting the external contour of the reservoir 6 containing a pressurized product P, and a duct or axial skirt 7 delimiting the internal contour of the reservoir 6. The reservoir body 2 has an annular setback 47 so as to receive a detachable lid (not shown) by catch engagement for example. The container also comprises a bottom 8 constituted by a transverse panel 9 and a lateral skirt 100 comprising an external profile capable of cooperating with the internal profile of the lower portion of the skirt 5, so as to ensure a leakproof mounting of the reservoir body 2 on the reservoir bottom element 8. The mounting may be obtained by any appropriate technique. By way of example, the body may be welded (by ultrasonic, mirror, or rotary (spin) welding), or screwed or catch engaged on the bottom. The reservoir bottom element 8 forms a valve-carrier cup for the intake valve 13. Advantageously, as shown in the drawing, the reservoir bottom element has a concavity 46 facing inwardly of the reservoir. This concavity permits an easier emptying of the reservoir and provides a higher resistance to internal pressure for the device as a whole.

The reservoir bottom element 8 forms an axial duct or skirt 10 with an external diameter slightly smaller than the internal diameter of the anal duct 7, so as to be capable of being mounted inside the axial duct 7 and of forming a valve body 11 which will be discussed in greater detail below. As shown in the drawing, the valve body 11 is delimited by an axial duct 10, the transverse panel 3 of the body and a part 12 of the reservoir bottom element 8 forming an axial setback 14 relative to the reservoir bottom element 8. The setback is of a slightly greater height than the height of the emergent portion of the valve stem 15, so as to prevent any accidental actuation of the intake valve 13.

The heights of the two axial skirts 7 and 10 are substantially the same, so that the free edge of the axial skirt 7 is substantially in contact with the internal side of the bottom. The free edge of the skirt 7 is welded to the bottom. Apart from the seal, this weld imparts to the container as a whole a greater strength, in particular a higher resistance to the pressure of the gas. This weld may be obtained by any means known to the expert (for example, ultrasonic welding, mirror welding, rotary (spin) welding, and adhesive bonding).

A bevel 16 is arranged on the internal circumference of the skirt 7. An opening 17 is arranged in the lower portion of the skirt 7 and opens in a groove or furrow 18 arranged, for example, over the whole height of the internal surface of the axial skirt 7. The groove 17 opens out at the top of the container in an opening 19, passing through the axial skirt 10. This arrangement allows the reservoir 6 to communicate with the valve body 11. Such a container is used in the upright position and is particularly suitable for the dispensing of lacquer, a hair lotion or a perfume, etc. According to a variant, the opening 17 in the axial skirt 7 is placed at the same level as the opening 19 in the axial skirt 10, so that no groove is required between the sides of the two axial skirts 7 and 10. This configuration allows the device to function upside down.

As has already been mentioned, the device in accordance with the first aspect of the invention comprises two valves 4 and 13 inside the same valve body 11. The first valve is a valve for the dispensing of the product. It comprises a valve stem 20 centred on the axis X, and comprising a portion 28 emerging outside the container through an opening arranged in the transverse side 3. On the emergent portion 28 of the valve stem 20 there is mounted a push button-type actuating and dispensing device. Advantageously, the transverse side defines an annular groove 22 between the lateral skirt 5 and the axial skirt 7, so as to receive the free annular edge 123 of the bush button. The depth of the groove 22 is chosen so as to allow the bush button sufficient axial travel for the actuation of the valve stem 20.

The seal of the mounting of the valve 4 is ensured by means of a gasket 23, having an external diameter substantially equal to the internal diameter of the axial skirt 7 and kept to bear against the transverse panel 3 by the upper annular edge of the axial skirt 10. The valve stem 20 is provided with at least one radial opening or passage 24, opening in an internal axial duct 25. The end 26 of the valve stem 20 opening inside the valve body 11 has a shoulder of which one side whereof bears on the gasket 23, preferably by means of a sealing ring 40. The other side forms a bearing surface for a first end 33 of a helical spring 27 whose restoring force keeps the shoulder in a bearing contact against the gasket 23. In this position, the opening 24 is opposite the gasket, which ensures a leakproof obturation of the said opening.

In this Figure, the gasket 23 is an attached gasket. In an alternative, the gasket is integral with the body of the device and is obtained by the duplex injection moulding of an elastomeric material during the manufacture of the reservoir body 2.

In accordance with the invention, mounted inside the valve body 11 is a second valve 13, which comprises a valve stem 15 orientated in the opposite direction to the valve stem 20 and situated in the axis X of the container 1. The valve stem 15 has a similar structure to that of the valve stem 20. This valve stem 15 has one end 29 opening outside the container in the setback 14 through an opening arranged in the part 12 of the bottom. The other end 30 opens inside the valve body 11 and forms a shoulder of which one side bears on a gasket 31 by means of a sealing ring 32. The other side of the shoulder serves as a support for the end 34 of the spring 27 on the opposite side to the end 33. Thus mounted, the spring keeps on the one hand the sealing ring 40 of the first valve 4 against the gasket 23, and on the other hand the sealing ring 32 of the valve 13 bearing against the gasket 31. In this closed position, a radial passage 35 of the valve stem 20 is opposite the gasket 31. The gasket 31 is mounted with a tight fit in the bottom 36 of the valve body. The valve stem is also mounted with a tight fit in the central opening of the gasket 31. Thus by actuating the valve stem 15 by depressing it axially into the valve body, the gasket 31 bends in its central portion towards the inside of the valve body, which releases the radial passage 35 and allows the product to pass while maintaining a seal between the gasket and the valve stem. By relaxing the pressure on the valve stem the gasket 31, held with a tight fit on the valve stem 15, resumes its initial position at the bottom of the valve body, the seal being completed by the presence of a sealing ring bearing on the gasket 31. The part 26 of the valve stem 20 situated inside the valve body 11 is extended in an axial portion 37 forming a stop for the part 30 of the valve stem 15, so as to prevent the valve stem 15 from completely entering the inside of the valve body 11 when it is axially depressed, which would render the device completely inoperative and would produce an inopportune emergence of the product P.

One thus obtains a structure having two valves 4 and 15 contained in the same valve body 11 and urged into their closed position by the same elastic element 27. Means other than a spring could be used. The two valves function independently.

Thus the dispensing of the product is ensured by actuating the actuating element or push button 21 which causes the valve stem 20 to descend and the opening 24 to communicate with the valve body. The pressurized product contained in the valve body 11 again rises into the internal duct 25 of the valve stem and is passed towards the outlet of the push button 21 via a dispensing element or dispensing duct 38. Alternatively, the actuating and dispensing means have a different structure and will advantageously comprise diffusion means (not shown) such as a nozzle, grille or a porous dome. By relaxing the pressure exerted on the push button 21, the restoring force of the spring 27 urges the part 26 to bear on the gasket 23, and the opening 24 opposite the gasket 23 thus interrupts the dispensing of the product P.

When the contents of the reservoir 6 have been used up, the user refills it by means of a pressurized container 41, at the top of which is crimped a valve 42. This valve comprises an emergent valve stem 43 having an internal duct 44 with a diameter slightly greater than the diameter of the end of the emergent stem 15 of the intake valve. Preferably, the end of the rod 15 has a frustoconical profile so as to promote the leakproof cooperation between the two valves 15 and 43. Thus, to refill the device 1, the valve stem 15 of the device 1 is applied to the end of the valve stem 43 of the auxiliary container 41 (FIG. 2A). By exerting an axial pressure on the refillable device 1 in the direction of arrow 147 (FIG. 2B), there is produced an axial depression of the valve stem 15 which causes the passage 35 to communicate with the inside of the valve body 11. The part 30 forms a stop against the portion 37 of the valve stem 20. By increasing the pressure on the device 1, the movement is transmitted to the valve stem 43 of the auxiliary device 41, which causes the stem 43 to descend and the valve 42 to be opened. The pressurized product contained in the device 41 rises in the duct 44 and is transferred into the internal duct 45 of the valve stem 15 and is then passed into the reservoir 6 via the passage 35, the valve body 11, the opening 19, the groove 18, the bevel 16, and the lower opening 17. The transfer continues until an equilibrium of the pressures is obtained between the device 41 and the device 1. The device 1, having thus been refilled, can be used again in the conditions described above.

With such a configuration, it should be noted that the travel of the valve stem 15 of the intake valve 13 between its rest position and its abutment position is very short, and corresponds to the depression distance necessary for proper functioning, increased by a slight clearance. It is in any case such that the emergent stem cannot completely enter into the valve body.

The container in accordance with the invention is advantageously made of a thermoplastic material, by using the same material, or two different, chemically compatible materials, to allow them to be bonded together. Of the materials that can be used in the present invention we may mention, for example, the group of polyolefins such as polypropylene, polyethylene and the copolymers of ethylene and propylene, the group of polyacetals such as polyoxyethylene. Polyethylene terephthalate, methyl polymethacrylate may also be used. Polybutylene terephthalate is advantageously used for reasons of impermeability and for preserving the formula. The polymer used for the device in accordance with the invention may also include fillers such as silica, glass fibres or carbon fibres.

In the embodiment described above, the product is pressurized by means of a liquefiable gas. It is obvious that other means may be provided for pressurizing the product, in particular for formulas not amenable to an aerosol action of the liquid-to-pasty, self foaming-type, etc. For these products, the pressurization is ensured either by a non-liquefiable gas bearing directly on the free surface of the product, or by means of a compressed gas which will be separated from the product by a flexible pouch or a piston. In the case of a piston, the piston used is provided on its circumference with sealing means of the sealing lip-type allowing a leakproof positioning of the piston in relation to the lateral skirt 5 and in relation to the axial skirt 7. The piston may have a profile matched to the profile of the bottom or to the upper transverse side 3 of the device 1, so as to allow the reservoir to be completely emptied. In the case of a pouch, one will use a deformable pouch fixed to a cylindrical coil. In all these embodiments it is necessary to provide openings of the ball valve type for the filling of the part separated from the product with propellant gas. These means are well known and therefore do not require any additional detailed description. According to another embodiment, the pressurizing of the product in the reservoir is ensured by means of a block of cellular foam with closed cells, in the form of a ring inserted before the bottom is joined to the body round the axial skirt 7. During the filling with the product the foam ring, preferably slit over its whole height, is compressed multidirectionally to ensure that the product in the reservoir is pressurized. By way of example, a nitrogen/plastic is used (a polyolefin foam and nitrogen gas) or a foamed rubber, buna, neoprene silicone, or any other material. The gas may be any gas which is compressible or liquefiable at the usual pressures, or it may be simply air. All these pressurizing means that can be used in accordance with the invention are described in detail in the French Application 96/05918 on the 13th May in the Applicant's name.

Figure 2B:
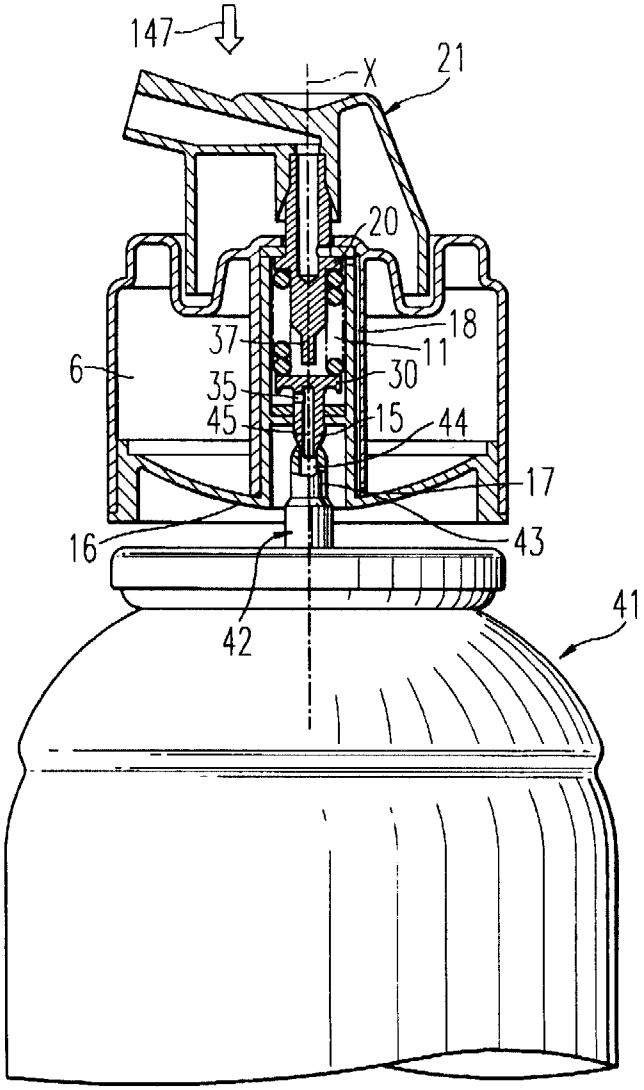
FIGS. 2*a* and 2*b* schematically illustrate the filling of the device of FIG. 1.
Figure 2A:
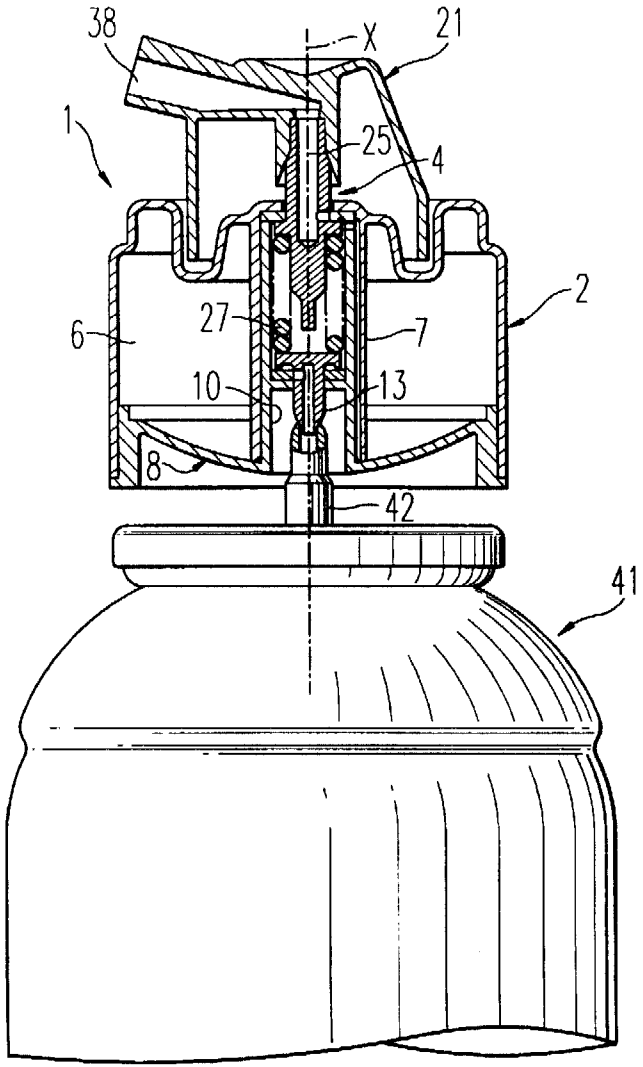
Figure 3A:
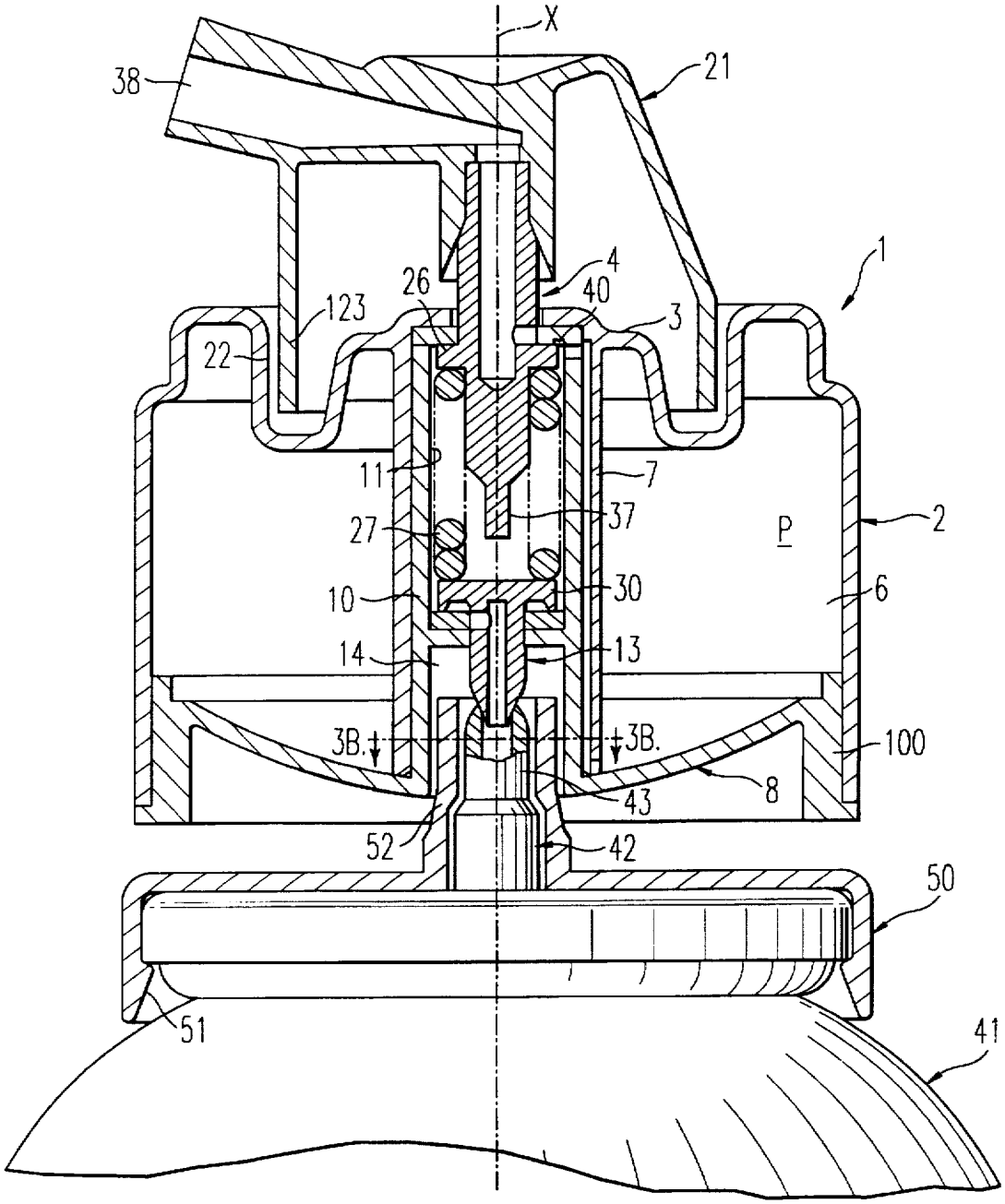
Figure 3A:
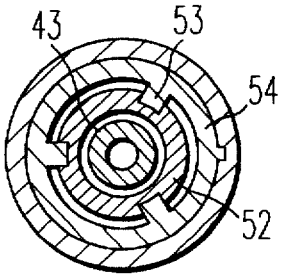

The embodiment illustrated in FIGS. 3A and 3B differs from that of FIGS. 1 and 2A–2B in that it comprises a security key which has two precise functions: on the one hand to protect the emergent stem and, on the other hand to prevent the device 1 from being filled by a product other than that intended by the manufacturer of the device. Such a key is formed by an adapter 50 comprising means 51 for allowing it to be mounted, by catch engagement for example, on the top of the auxiliary device 41. The adapter comprises an anal duct 52 which is force-fitted on the valve stem 43 of the valve 42. The axial duct 52 has a diameter slightly smaller than the internal diameter of the setback 14. The axial duct 52 has a height slightly greater than the height of the valve stem 43, so that an inopportune opening of the valve 42 cannot be triggered simply by any object bearing on the top of the stem 43. As shown more clearly in the sectional view of FIG. 3B, the outer walls of the setback 14 have a profile of a catch type capable of cooperating with a complementary profile of the outer wall of the axial duct 52.

Figure 4:
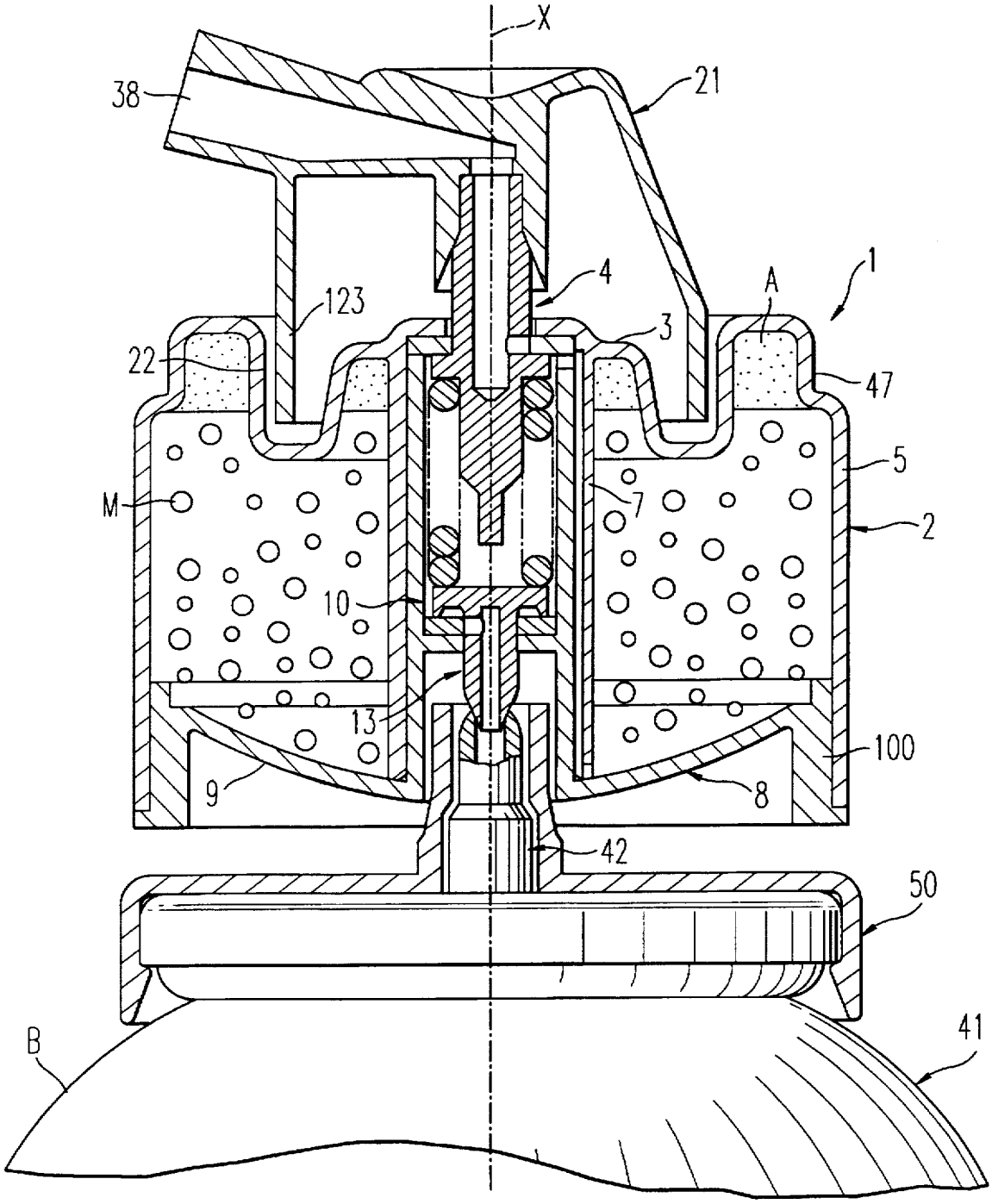
FIG. 4 illustrates the mixer-type application of the device in accordance with the invention.

FIG. 4, to which reference will now be made, illustrates another advantageous use of the device in accordance with the invention. According to this application, the device is used as a mixer of two active ingredients A and B which can be mixed only just before their use. Before the bottom is joined to the body, the body is upended and a given quantity of a product A is introduced through an opening on the opposite side to the transverse panel 3. The galenical form is unimportant: one could envisage a powder such as vitamins or enzymes, or again a liquid or a cream, such as silicone in the case of hair styling and fixing sprays. In the case of products amenable to an aerosol action, the bottom is subsequently welded onto the body. In the case of products not amenable to an aerosol action, a ring M of foam with closed cells is advantageously disposed above the product. When the bottom has been joined to the body, the foam ring M occupies the whole space situated above the product A and is preferably slightly compressed. One then proceeds to add the active ingredient B through the intake valve 13 in the way described with reference to FIGS. 2A and 2B, by placing the device 1 onto the device 41 via the adaptor 50. The product B is pressurized in the auxiliary device 41, either by a liquefiable propellant gas, or by a closed cell foam block, or by any other propellant means isolated from the product B by a flexible pouch or a piston. In the case of a product amenable to an aerosol action, the mixing occurs straight away and can be immediately used. In the case of a product not amenable to an aerosol action, the closed cell thermoplastic foam will contract at the moment of the intake of the product B, and will allow the product B to reach the first product A, possibly performing the function of an agitator to help with the mixing of the two active ingredients. For this purpose, the foam ring can be slit over its whole height, thus forming an open ring so as allow it to contract in all directions (laterally and longitudinally). The open ring can thus contract to such a point that it only partially surrounds the duct 7, and this only over a portion of its height, thus allowing the product B to mix with the product A. As the pressure in the device drops, the open foam ring resumes its initial shape around the duct 7. The mixture is thus ready for use. From a commercial aspect, provision may be made for selling a kit comprising several mini-devices 1 partially filled with the active ingredient A, and also a larger container having a capacity and pressure sufficient to fill all the mini-devices of the kit. The kit will optionally comprise a transfer adapter between the large container and the mini-devices. Alternatively, the mini-devices are delivered empty and are sold with two auxiliary pressurized cans, one containing the product A, the other containing the product B. The user first transfers a given quantity of the product A in the way described above with reference to the preceding Figures, then in the same way he adds a quantity of the product B to the device partially filled with the product A, so as to fill up the reservoir and to form a mixture A+B.

In the preceding detailed description, reference has been made to preferred modes of embodiments. It is obvious that variants can be introduced into them without departing from the spirit of the invention such as claimed below.

What is claimed as new and desired to be secured by Letters Patent of the United States is:

1. A device comprising:

a reservoir for a pressurized product:

a valve body in communication with said reservoir;

a first valve mounted in said valve body, said first valve movable between an open position and a closed position;

a second valve mounted in said valve body, said second valve oriented in a direction opposite to that of said first valve and substantially in alignment with said first valve, said second valve movable between an open position and a closed position;

an actuating element attached to at least one of said first valve and said second valve, said actuating element having a dispensing element for dispensing the pressurized product in said reservoir; and an elastic element for urging said first valve and said second valve to said closed positions.

2. A device according to claim 1, wherein at least one of said first valve and said second valve includes an emergent valve stem.

3. A device according to claim 1, wherein at least one of said first valve and said second valve includes a female element detachably connected to an actuating stem.

4. A device according to claim 1, wherein said actuating element is a push button mounted on said first valve for dispensing of the product, and said second valve being mountable on a second device for filling said reservoir with the product.

5. A device according to claim 1, further comprising a reservoir body, and a reservoir bottom element connected to said reservoir body forming said reservoir for the pressurized product and forming said valve body, said reservoir body having a valve carrier cup so as to accommodate said first valve, and said reservoir bottom element having a valve carrier cup so as to accommodate said second valve.

6. A device according to claim 5, wherein said first valve includes a first valve stem, said first valve stem having a first end which opens inside said valve body and a second end which opens outside said valve body, and wherein said second valve has a second valve stem, said second valve stem having a third end which opens inside said valve body substantially opposite said first end of said first valve stem, and having a fourth end which opens outside said valve body, and wherein said elastic element is formed by a spring, said spring bearing between the said first end of said first valve stem and said third end of said second valve stem.

7. A device according to claim 6, wherein said reservoir body is mounted in a leakproof manner on said reservoir bottom element by welding, catch engagement, screwing or adhesive bonding.

8. A device according to claim 6, wherein said reservoir body has a first transverse wall forming a first valve-carrier cup for said first valve, a first lateral skirt delimiting an outer contour of said reservoir, and a first central duct having a diameter which delimits an internal contour of said reservoir, and wherein said reservoir bottom element has a second transverse wall forming a second valve-carrier cup for said second valve and has a second lateral skirt, said second lateral skirt cooperating with the first lateral skirt for fastening said reservoir bottom element onto said reservoir body, and has a second central duct forming said valve body, wherein said second transverse wall forms a valve body bottom for said valve body, wherein said second central duct has an external diameter slightly smaller than an internal diameter of said first central duct, and further comprising means for permitting communication between said reservoir and said valve body.

9. A device according to claim 8, wherein said third end of said second valve stem has a substantially flat portion, one side of said substantially flat portion situated opposite said valve body bottom, wherein said second valve is held in said closed position by elastic bearing contact between a sealing ring formed on a side of said third end of said second valve stem and a gasket traversed by said second valve stem and disposed in said valve body bottom, and wherein said gasket is in tight contact, on the one hand with internal sides of said second central duct and, on the other hand, with said second valve stem.

10. A device according to claim 8, wherein said first transverse wall of said reservoir body has, on an outer surface of the device, an annular groove between said first lateral skirt and said first central duct so as to receive a free edge of said actuating element.

11. A device according to claim 8, wherein said first and second central ducts are of substantially the same height, said first central duct having a free edge welded to said second transverse wall of said reservoir bottom element.

12. A device according to claim 7, wherein the reservoir bottom element has a setback in which emerges said second valve stem, said setback having a height along an axis of the device greater than a height of the emergent portion of said second valve stem.

13. A device according to claim 12, wherein said setback has on an outside surface of the device a profile forming a key, said profile having a shape complementary to that of an adapter intended to be mounted on an auxiliary container, so as to provide for the filling or refilling of the device.

14. A device according to claim 7, wherein said reservoir bottom element has, between said second lateral skirt and said second central duct, a rounded annular profile having a concavity facing towards an inside of said reservoir.

15. A device according to claim 7, wherein said first end of said first valve stem forms an axial stop so as to limit movement of said second valve stem during opening of said second valve, during filling or refilling of the reservoir.

16. A device according to claim 7, wherein said fourth end of said second valve stem opening outside the device has a shape adapted for cooperating with a free end of a valve stem of a pressurized auxiliary container, so as to enable filling or refilling of the device.

17. A device according to claim 16, wherein said fourth end of said second valve stem has a frustoconical profile.

18. A device according to claim 8, wherein said means permitting communication between said reservoir and said valve body are arranged so as to allow the device to function upside down or the right way up.

19. A device according to claim 1, wherein said product is pressurized by means of an element made of a cellular material with closed cells, or by means of a liquefiable gas admixed to the product, or by means of a non-liquefiable gas above the free surface of the product, or by means of a pressurized gas separated from the product by means of a flexible or rigid piston or pouch-type element.

20. A unit for the preparation of an extemporaneous mixture of at least first and second products, intended to be dispensed under pressure, comprising:

at least one first device comprising, a reservoir partially filled with the first product at a pressure, a valve body in communication with said reservoir, a first valve mounted in said valve body, said first valve movable between an open position and a closed position, a second valve mounted in said valve body, said second valve oriented in a direction opposite to that of said first valve and substantially in alignment with said first valve, said second valve movable between an open position and a closed position, said second valve provides for intake of the second product into said reservoir, an actuating element attached to said first valve, said actuating element having a dispensing element for dispensing the mixture in the reservoir, and an elastic element for urging said first valve and said second valve to said closed positions;

a second device formed by a reservoir containing the second product at a pressure higher than said pressure in said at least one first device, said second device having means for dispensing the pressurized second product, said dispensing means cooperating with said second valve of said at least one first device so as to transfer the second product into said at least one first device; and means for pressurizing the mixture of at least the first product and the second product in said at least one first device.

21. A unit according to claim 20, further comprising an adapter attached to said second device, said adapter surrounding said dispensing means of said second device, said adapter having a shape that cooperates with said second valve of said at least one first device so as to transfer the second product into said at least one first device.

22. A unit according to claim 20, wherein said means for pressurizing the mixture of at least said first product and said second product in said at least one first device comprise a liquefiable propellant gas, or a non-liquefiable propellant gas optionally separated from the mixture by a flexible pouch or a piston.

23. A unit according to claim 20, wherein said means for pressurizing the mixture of at least said first product and second product in said at least one first device comprise a cellular foam block having closed cells.

24. A unit according to claim 21, wherein the second product is kept under pressure in said reservoir of said second device by a liquefiable propellant gas, a cellular foam block having closed cells, or a non-liquefiable propellant gas optionally separated from the mixture by a piston or a flexible pouch.

25. A method of use of the unit according to claim 20 for the extemporaneous mixing of at least the first and second products.

26. A method of use of the unit according to claim 20 for the preparation of the mixture of at least the first and second products intended to be dispensed under pressure.

27. A method of use according to claim 26, wherein the first product is placed into said at least one first device during assembly of said at least one first device.

28. A method of use according to claim 26, wherein the first product is placed into said at least one first device after assembly of said at least one first device by transfer of the first product from another pressurized device.

29. A method of use according to claim 26, wherein the first product takes the form of a powder, a liquid or a cream.

30. A method of use according to claim 26, wherein the mixture of the first and second products is chosen from the following mixtures: keratolytic enzymes/a moisturising lotion, vitamins/ a nourishing cream, fixing sprays/gloss sprays, a hair styling foam/combing-out foam.

* * * * *